United States Patent [19]

Chevich

[11] Patent Number: 4,777,883

[45] Date of Patent: Oct. 18, 1988

[54] BULLET

[76] Inventor: Milija M. Chevich, 1530 Bellows, Apt. 206, W. St. Paul, Minn. 55118

[21] Appl. No.: 145,378

[22] Filed: Jan. 19, 1988

[51] Int. Cl.[4] ..... F42B 11/00

[52] U.S. Cl. ..... 102/503; 102/509; 102/516; 102/517

[58] Field of Search ..... 102/503, 507, 508, 509, 102/510, 514, 515, 516, 517, 501, 532

[56] References Cited

U.S. PATENT DOCUMENTS 1,327,531 1/1920 Durham ..... 102/

2,045,964 6/1936 Runkel ..... 102/

4,436,035 3/1984 Strandli ..... 102/

4,485,742 12/1984 Mamo ..... 102/

4,627,357 12/1986 Gobis ..... 102/

*Primary Examiner*—Harold J. Tudor

*Attorney, Agent, or Firm*—Thomas B. Tate

[57] ABSTRACT

The invention is a bullet which comprises a hollow central cavity, an outside plastic jacket, a lead core, an inside metal jacket, a slotted nose, a gas seal, a gas seal reinforcement disc, and a gas seal extension having slotted seal feathers.

1 Claim, 5 Drawing Sheets

BULLET

SUMMARY OF THE INVENTION

An advantage of the invention over conventional bullets is that, because the center is hollow, the accuracy is increased, and the range is also increased because there is less surface exposed to air, and the aerodynamic coefficient is higher.

Another advantage of the invention is that there is better control of the rate of expansion and depth of penetration because the bullet has an inside jacket. The rate of expansion is not dependent upon the velocity as in conventional bullets.

Still another advantage is that the invention is lighter than conventional bullets, and therefore has much higher velocity, and less recoil because of the light weight.

DESCRIPTION OF THE DRAWINGS

FIG. 5 shows the bullet just after the trigger has been pulled, before initial movement.

FIG. 6 shows the bullet after initial movement, as its nose collapses in on itself.

FIG. 7 shows the bullet exiting the barrel. The slotted feathers start to open.

FIG. 8 shows the gas seal spinning off, out of the way.

FIG. 9 shows the bullet making impact downrange.

DESCRIPTION OF THE INVENTION

Figure 1:
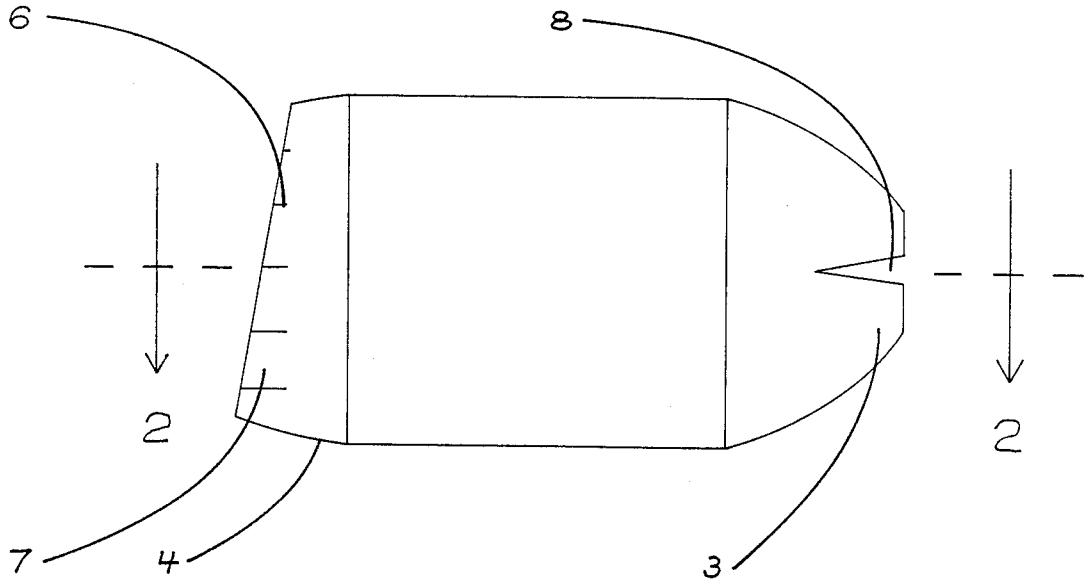
FIG. 1 is a side view.
Figure 2:
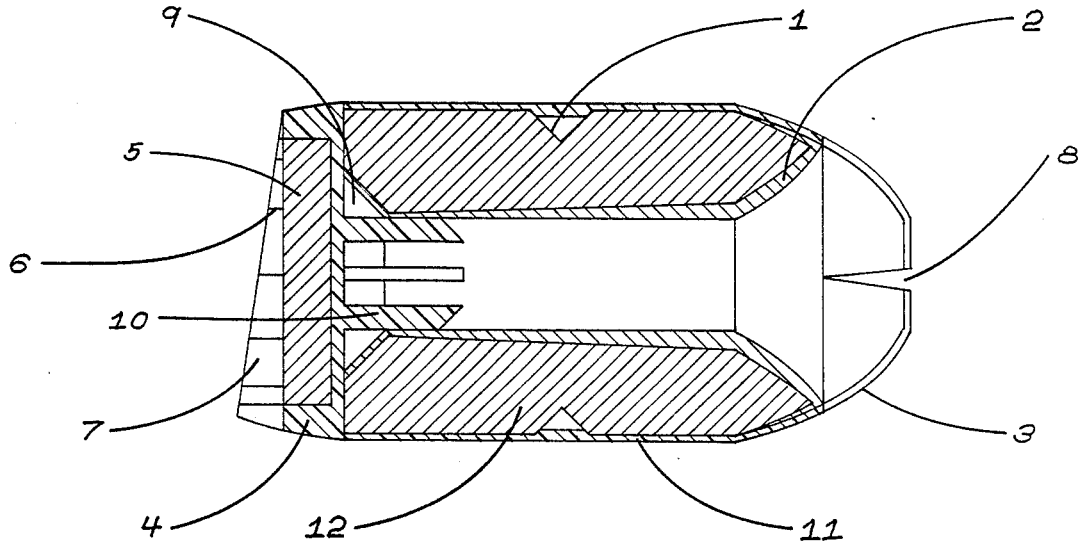
FIG. 2 is a cross-section view taken along line 2—2 of FIG. 1.
Figure 3:
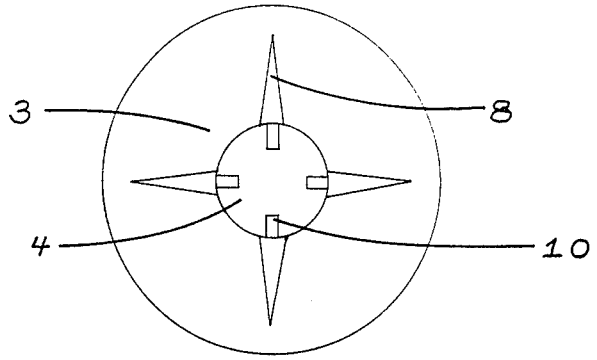
FIG. 3 is top view.
Figure 4:
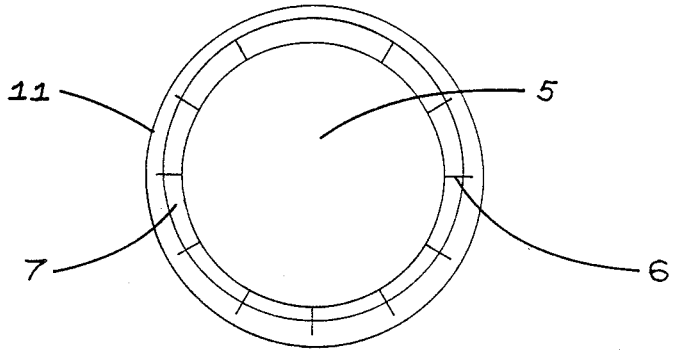
FIG. 4 is a back view.
Figure 5:
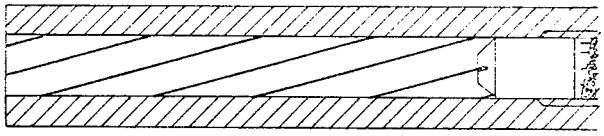
FIGS. 5–9 are an action sequence as follows.
Figure 6:
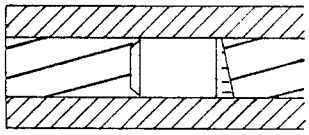
Figure 7:
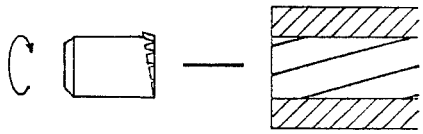
Figure 8:
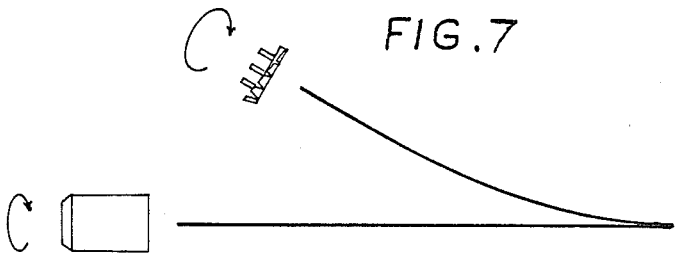
Figure 9:
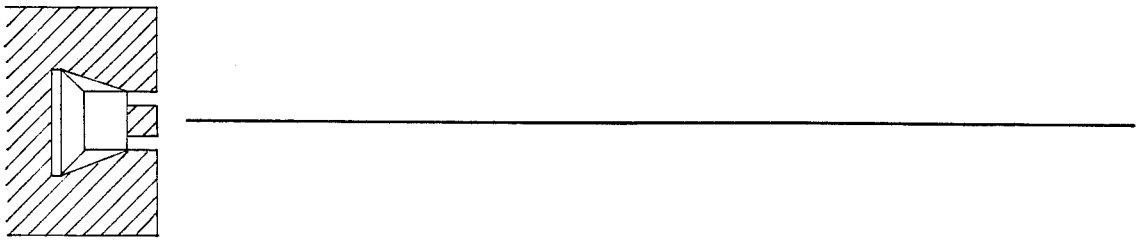

The bullet has a plastic (or other suitable materials) jacket 11 which extends beyond the front of the bullet itself to form a nose or feed lips 3 which aid in feeding an automatic weapon. The feed lips 3 have a slotted collapse notch 8, which collapses inward upon itself when the bullet is fired, as a result of the G-forces in the barrel of the gun. The lead core 12 is provided with V-shaped (in cross section) size expansion control notch 1 on either side. The notch actually forms a ring around the inside of the bullet. Jacket-retaining is one of the purposes of notch 1, which pushes the jacket 11 forward. The position of the notch 1 along the sides of the core 12 controls the amount of expansion of the bullet. If the notch 1 is located toward the front, the expansion is smaller; conversely, if the notch is toward the back, the expansion is larger. The outside jacket 11 surrounds the lead core 12.

A metallic inside jacket 2 covers the nose and extends from the front to the back on the inside of the bullet, but does not touch the barrel of the gun. The rate of expansion of the bullet depends upon the type of metal used for the inside jacket 2. Brass or other softer metals provide bigger expansion, which is desirable for bullets used for hunting. Thicker, tougher metals provide less expansion, and expansion can be eliminated altogether by using steel, thereby conforming to the Geneva Convention if this design is used for military bullets.

The center of the bullet is hollow. The back end of the hollow central cavity is plugged by a plastic gas seal 4. The gas seal 4 seals the cartridge to prevent moisture from entering the shell and also prevents leakage of gases from the bullet. The gas seal 4 has at least two legs or fingers 10 which extend into the hollow cavity and hold the seal 4 in place while the bullet is being loaded. A triangular (in cross section) seal channel 9 (actually circling the inside of the bullet) is formed between the seal-retaining fingers 10 and the inside jacket 2 on either side. Because of the seal channels 9, the lead core 12 is curved at the back, thus providing better accuracy than if it were squared off. The gas seal 4 is hollowed out in back so that a steel reinforcement disc 5 can be inserted. Behind the reinforcement disc 5 is a gas seal extension comprising seal feathers 7 with seal feather notches 6 between them. Because this gas seal extension is formed [diagonally] as a rear annular surface which lies in a plane which is obliquely with respect to the longitudinal axis of the bullet, the gases push harder on the larger side, thus tipping the extension on its side and causing the notches 6 to open like feathers (similar to a badmitton shuttlecock) to decrease the acceleration rate of the gas seal. Thus the gas seal flips out immediately after the bullet is fired instead of following the bullet before dropping, and is thereby deflected away from the line of fire to give better visibility and to prevent following bullets from hitting it. Centripetal forces aid in the deflection.

Because of its hollow shape, the bullet could be die-formed instead of mold-cast as are conventional bullets. A doughnut-shaped piece of lead can be put into a die, and then forces can be applied to produce the desired shape. The outside and inside jackets can be attached also by die-pressing.

I claim:

1. A bullet having a hollow central cavity, said bullet comprising:

an outside jacket surrounding a solid core, said outside jacket extending beyond said core anteriorly to form collapsible feed lips which have notches formed between them, said core also having an expansion control notch formed into its surface;

an inside jacket extending the length of said bullet internally, said inside jacket being situated between said core and said hollow central cavity;

a gas seal attached to said core at the posterior end thereof and having projections extending into said hollow central cavity, said gas seal being reinforced by a reinforcement disc inserted into a hollow formed in said gas seal, and also having a rear annular surface which lies in a plane which is oblique with respect to the longitudinal axis of said bullet, said surface having notched seal feathers.

* * * * *

UNITED STATES PATENT AND TRADEMARK OFFICE

CERTIFICATE OF CORRECTION

PATENT NO. : 4,777,883

DATED : October 18, 1988

INVENTOR(S) : Milija M. Chovich

It is certified that error appears in the above-identified patent and that said Letters Patent is hereby corrected as shown below:

On the title page, Items [19] and [76], the inventor's last name should read --Chovich--.

Signed and Sealed this

Seventh Day of February, 1989

*Attest:*

DONALD J. QUIGG

*Attesting Officer*

*Commissioner of Patents and Trademarks*